US006722353B2

(12) United States Patent
Huang

(10) Patent No.: US 6,722,353 B2
(45) Date of Patent: Apr. 20, 2004

(54) SAFETY REMOTE CONTROL AND EMERGENCY SAFETY SWITCH POWER SHUTOFF DEVICE OF A MOTORIZED BEACH VEHICLE

(75) Inventor: Shu-Fang Huang, Taipei (TW)

(73) Assignee: Taiwan ATV Industrial Co., Ltd., Taipei (TW)

( * ) Notice: Subject to any disclaimer, the term of this patent is extended or adjusted under 35 U.S.C. 154(b) by 87 days.

(21) Appl. No.: 10/140,413

(22) Filed: May 6, 2002

(65) Prior Publication Data

US 2003/0205220 A1 Nov. 6, 2003

(51) Int. Cl.[7] ..... F02B 51/00

(52) U.S. Cl. ..... 123/630; 123/198 DC; 180/272

(58) Field of Search ..... 123/630, 198 DC, 123/198 D; 180/272; 440/1

(56) References Cited

U.S. PATENT DOCUMENTS 4,037,683 A * 7/1977 LeBell ..... 180/272
4,762,968 A * 8/1988 Hilton ..... 200/52 R
5,171,171 A * 12/1992 Tani ..... 440/1
6,024,068 A * 2/2000 Nakase et al. ..... 123/198 D
6,352,045 B1 * 3/2002 Takashima ..... 114/55.5

* cited by examiner

*Primary Examiner*—Mahmoud Gimie
(74) *Attorney, Agent, or Firm*—Alan Kamrath

(57) ABSTRACT

A motorized beach vehicle with a safety remote control and emergency safety switch power shutoff device includes a CDI unit having an engine operation stopping line that is connected to a relay, a remote control unit, and a safety switch. The safety switch includes two lines connected to the relay. An electrically conductive seat is mounted on the two lines, and an elastic sleeve is mounted on the electrically conductive seat. A rubber cap is mounted on the safety switch, and is connected to a first end of a strap which has a second end that may be tied on a driver's body, so that the rubber cap may be detached from the safety switch by the strap in an emergency condition.

3 Claims, 11 Drawing Sheets

FREQ. = 433.92MHz

SAFETY REMOTE CONTROL AND EMERGENCY SAFETY SWITCH POWER SHUTOFF DEVICE OF A MOTORIZED BEACH VEHICLE

BACKGROUND OF THE INVENTION

1. Field of the Invention

The present invention relates to a safety remote control and emergency safety switch power shutoff device of a motorized beach vehicle, and more particularly to a safety remote control and emergency safety switch power shutoff device of a motorized beach vehicle, wherein when the driver falls from the motorized beach vehicle the rubber cap may be automatically detached from the safety switch, thereby shutting the engine operation stopping line of the CDI unit, so as to stop operation of the motorized beach vehicle.

2. Description of the Related Art

A conventional motorized beach vehicle in accordance with the prior art is not provided with a remote control and emergency shutoff device. FIG. 1 shows a circuit block diagram of the conventional motorized beach vehicle in accordance with the prior art. When the conventional motorized beach vehicle is driven on the beach having a rugged or corrugated configuration, the driver cannot control the vehicle easily and stably, and the driver probably falls out of the vehicle due to vibration or oscillation. The conventional motorized beach vehicle is not provided with a safety switch or an emergency shutoff device to stop operation and movement of the vehicle, so that the vehicle will still travel forward successively in such an emergency situation, thereby easily injuring the driver.

SUMMARY OF THE INVENTION

The present invention has arisen to mitigate and/or obviate the disadvantage of the conventional motorized beach vehicle.

The primary objective of the present invention is to provide a safety remote control and emergency safety switch power shutoff device of a motorized beach vehicle, wherein when the driver falls from the motorized beach vehicle or when the drive cannot control and operate the motorized beach vehicle normally, the rubber cap may be automatically detached from the safety switch by pulling of the strap, thereby shutting the engine operation stopping line of the CDI unit of the driving motorized beach vehicle, so as to stop operation of the motorized beach vehicle.

In accordance with the present invention, there is provided a motorized beach vehicle with a safety remote control and emergency safety switch power shutoff device, comprising an ACG (alternating current magneto generator) assembly, and a CDI (capacitor discharge ignition) unit for controlling an engine to operate normally or stop operating, an electrical power of the CDI unit being supplied by a battery, wherein:

the CDI unit has an engine operation stopping line that is connected to a relay, a remote control unit, and a safety switch;

the remote control unit receives an on/off signal transmitted from a remote controller, to energize the relay, so as to shutoff or conduct the engine operation stopping line of the CDI unit; and the safety switch includes two lines connected to the relay, each of the two lines is disposed at a normally open state, an electrically conductive seat is mounted on the two lines, an elastic sleeve is mounted on the electrically conductive seat, the safety switch is mounted on the elastic sleeve, a rubber cap is mounted on the safety switch, the rubber cap is connected to a first end of a strap which has a second end that is tied on a driver's body, so that the rubber cap is detached from the safety switch by the strap in an emergency condition.

Further benefits and advantages of the present invention will become apparent after a careful reading of the detailed description with appropriate reference to the accompanying drawings.

DETAILED DESCRIPTION OF THE INVENTION

Figure 1:
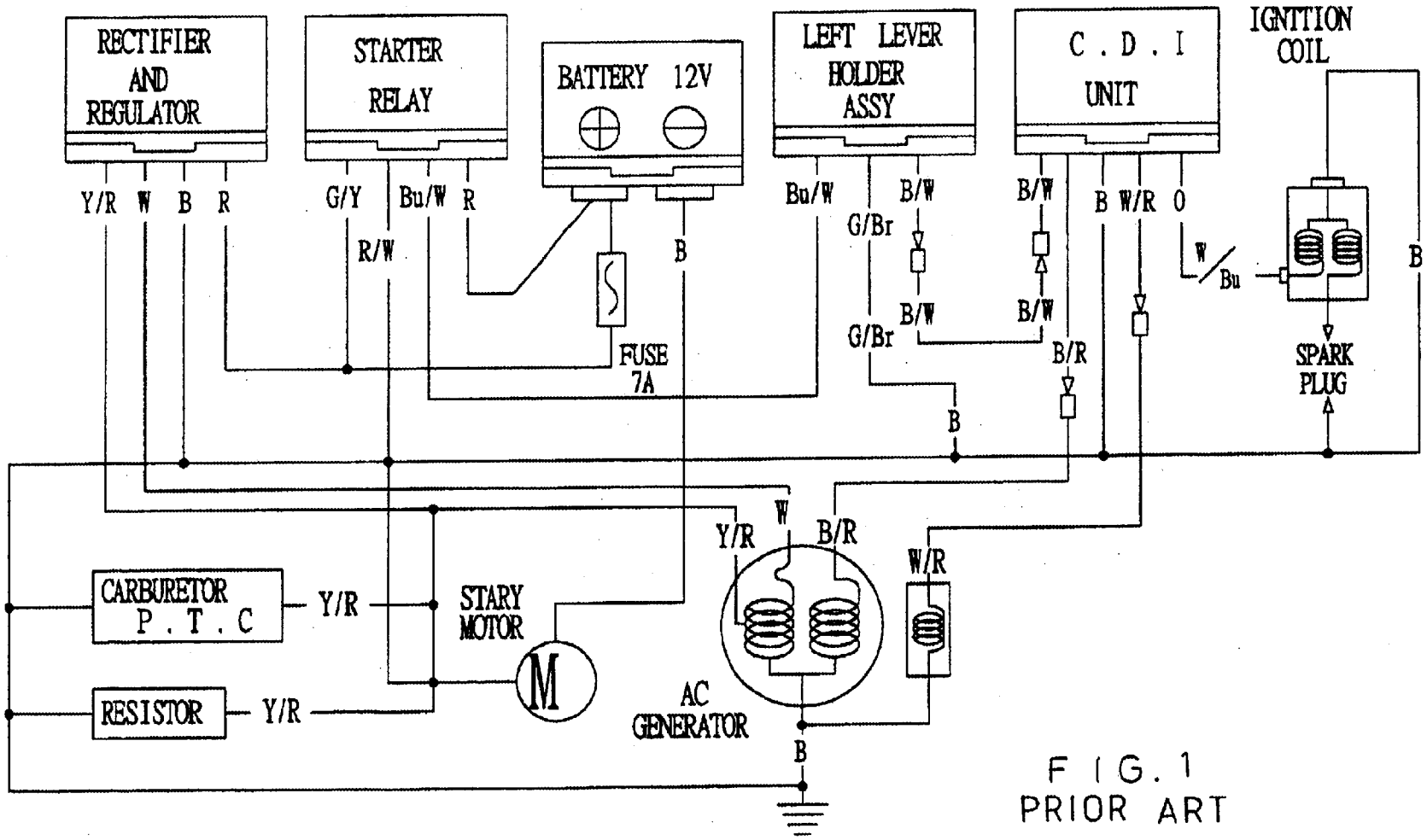
FIG. 1 PRIOR ART
FIG. 1 is a circuit block diagram of a conventional motorized beach vehicle in accordance with the prior art.
Figure 2:
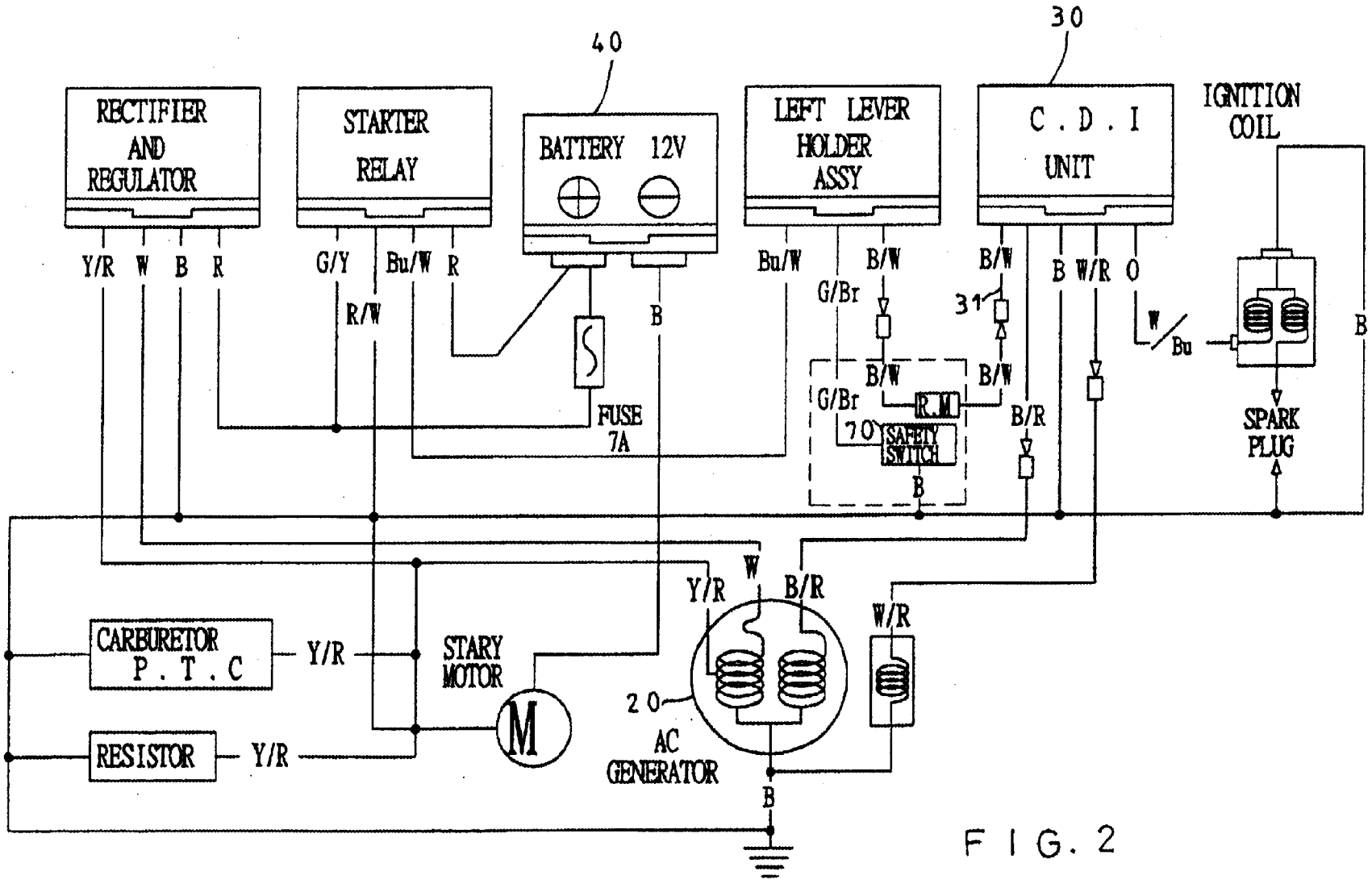
FIG. 2 is a circuit block diagram of a safety remote control and emergency safety switch power shutoff device of a motorized beach vehicle in accordance with a preferred embodiment of the present invention.
Figure 3:
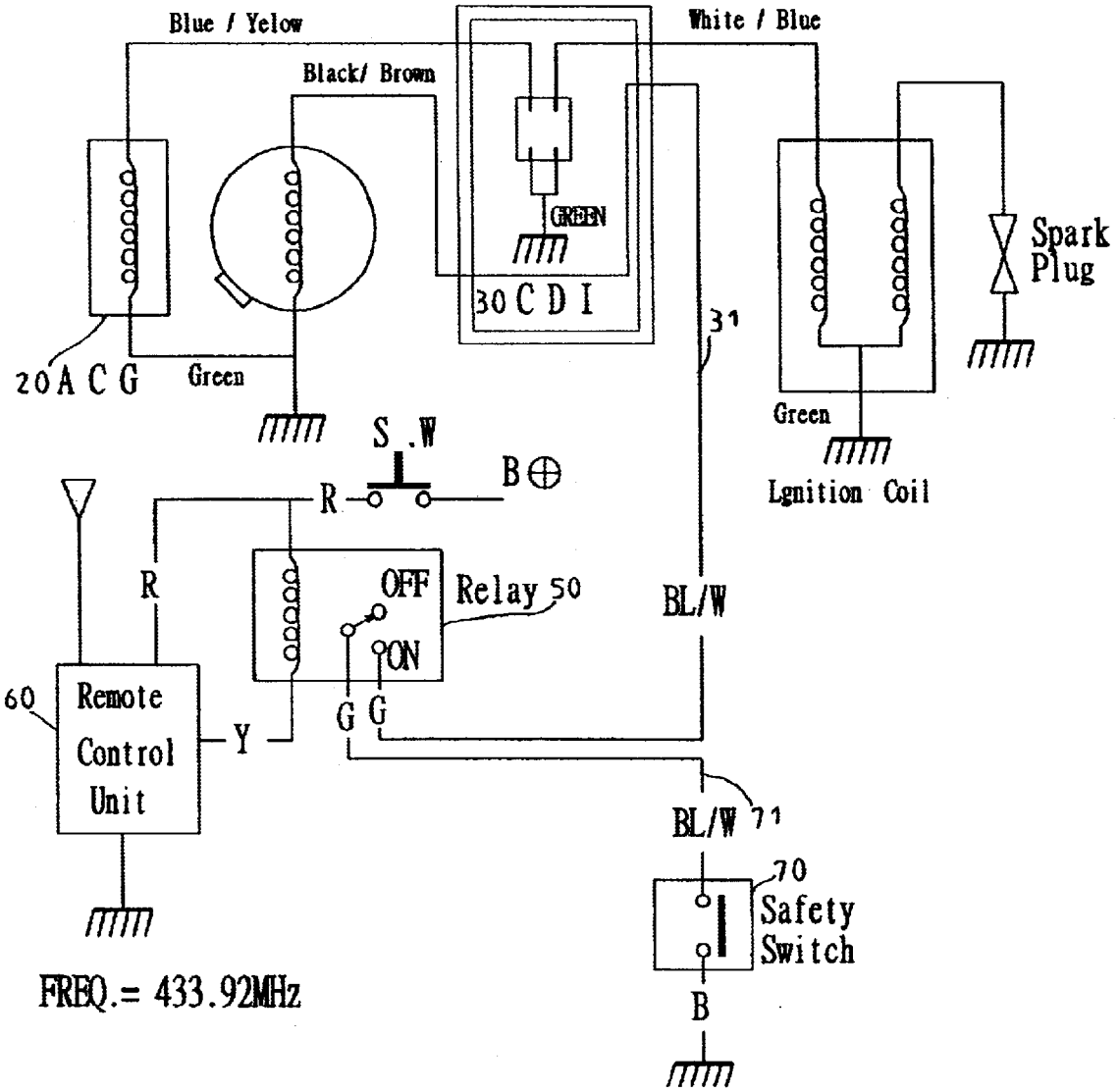
FIG. 3 is a circuit layout diagram of the safety remote control and emergency safety switch power shutoff device of a motorized beach vehicle in accordance with the preferred embodiment of the present invention.

Referring to the drawings and initially to FIGS. 2 and 3, a safety remote control and emergency safety switch power shutoff device of a motorized beach vehicle in accordance with a preferred embodiment of the present invention is shown, wherein FIG. 2 is a circuit block diagram of the safety remote control and emergency safety switch power shutoff device of a motorized beach vehicle in accordance with the preferred embodiment of the present invention, and FIG. 3 is a circuit layout diagram of the safety remote control and emergency safety switch power shutoff device of a motorized beach vehicle in accordance with the preferred embodiment of the present invention;

The motorized beach vehicle 10 (see FIG. 9) includes an ACG (alternating current magneto generator) assembly 20, and a CDI (capacitor discharge ignition) unit 30 for controlling the engine to operate normally or stop operating.

The electrical power of the CDI unit 30 is supplied by the battery 40.

The characteristic of the present invention is in that: the CDI unit 30 has an engine operation stopping line 31 that is connected to a relay 50, a remote control unit 60, and a safety switch 70.

Figure 4:
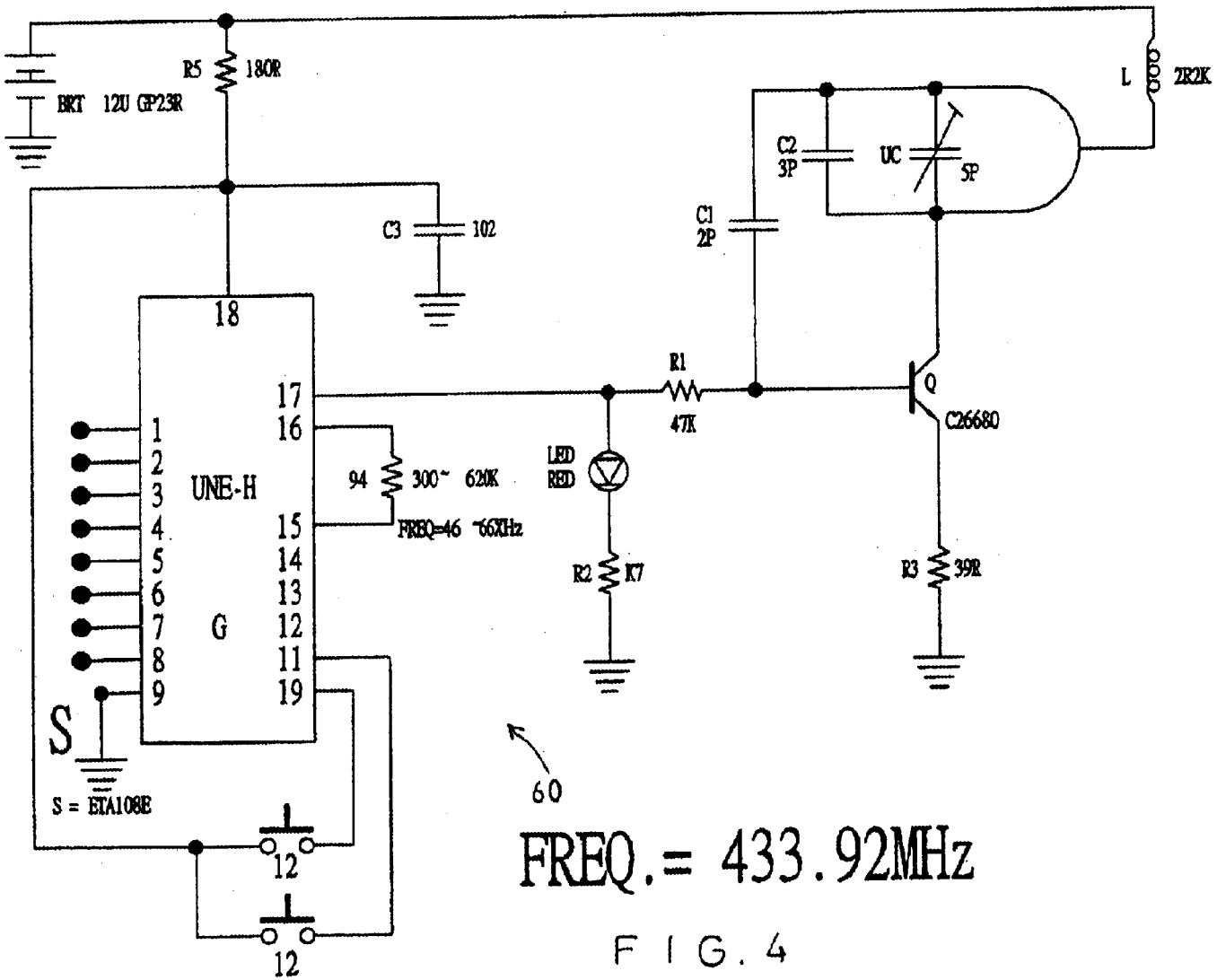
FIG. 4 is a circuit layout diagram of a remote control unit of the safety remote control and emergency safety switch power shutoff device of a motorized beach vehicle in accordance with the preferred embodiment of the present invention.
Figure 5:
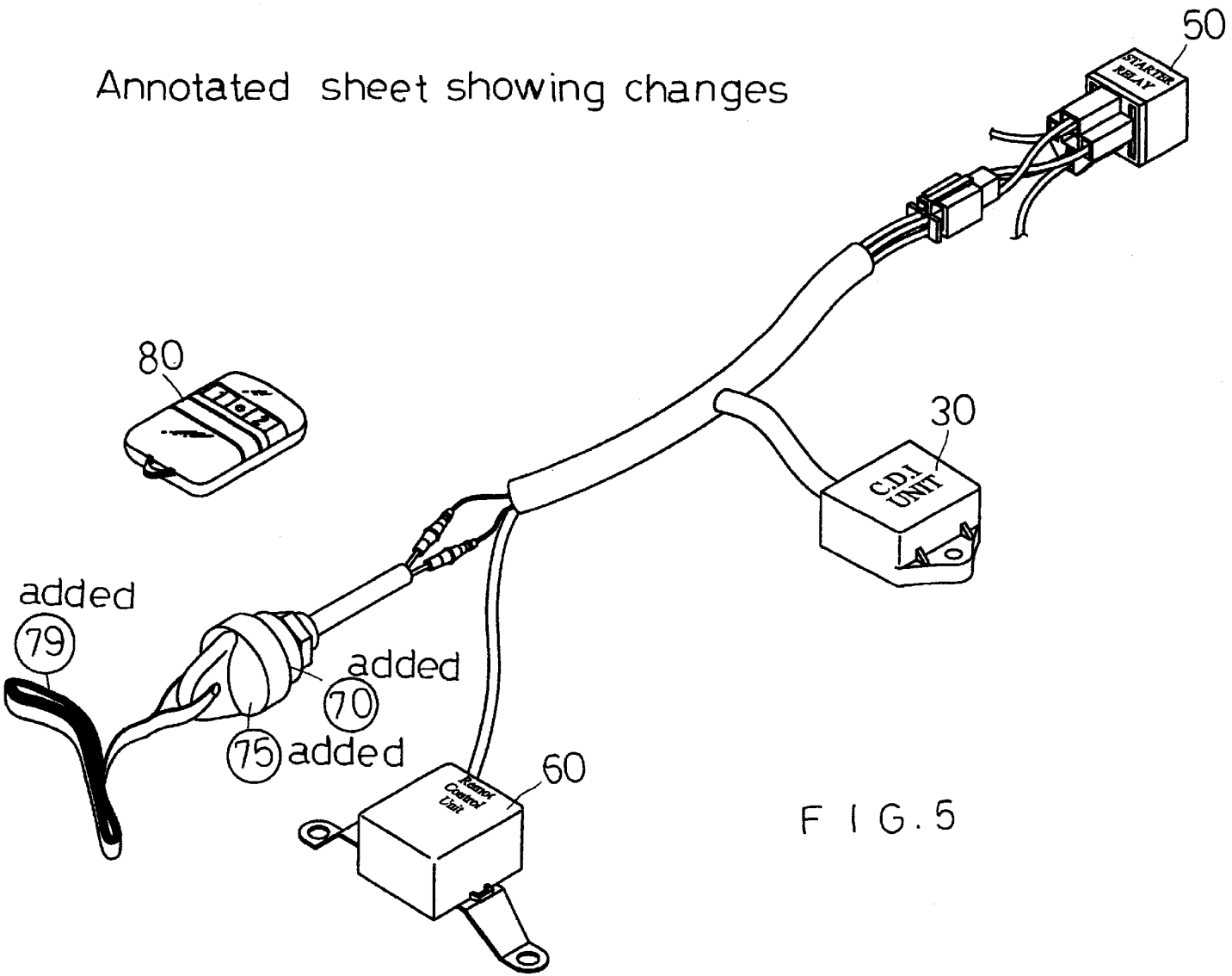
FIG. 5 is a schematic perspective view of the safety remote control and emergency safety switch power shutoff device of a motorized beach vehicle in accordance with the preferred embodiment of the present invention.

Referring to FIGS. 4 and 5, FIG. 4 is a circuit layout diagram of a remote control unit of the safety remote control and emergency safety switch power shutoff device of a motorized beach vehicle in accordance with the preferred embodiment of the present invention, and FIG. 5 is a schematic perspective view of the safety remote control and emergency safety switch power shutoff device of a motorized beach vehicle in accordance with the preferred embodiment of the present invention.

The remote control unit 60 may receive the on/off signal transmitted from the remote controller 80, to energize the relay 50, so as to shutoff or conduct the engine operation stopping line 31 of the CDI unit 30.

Figure 6:
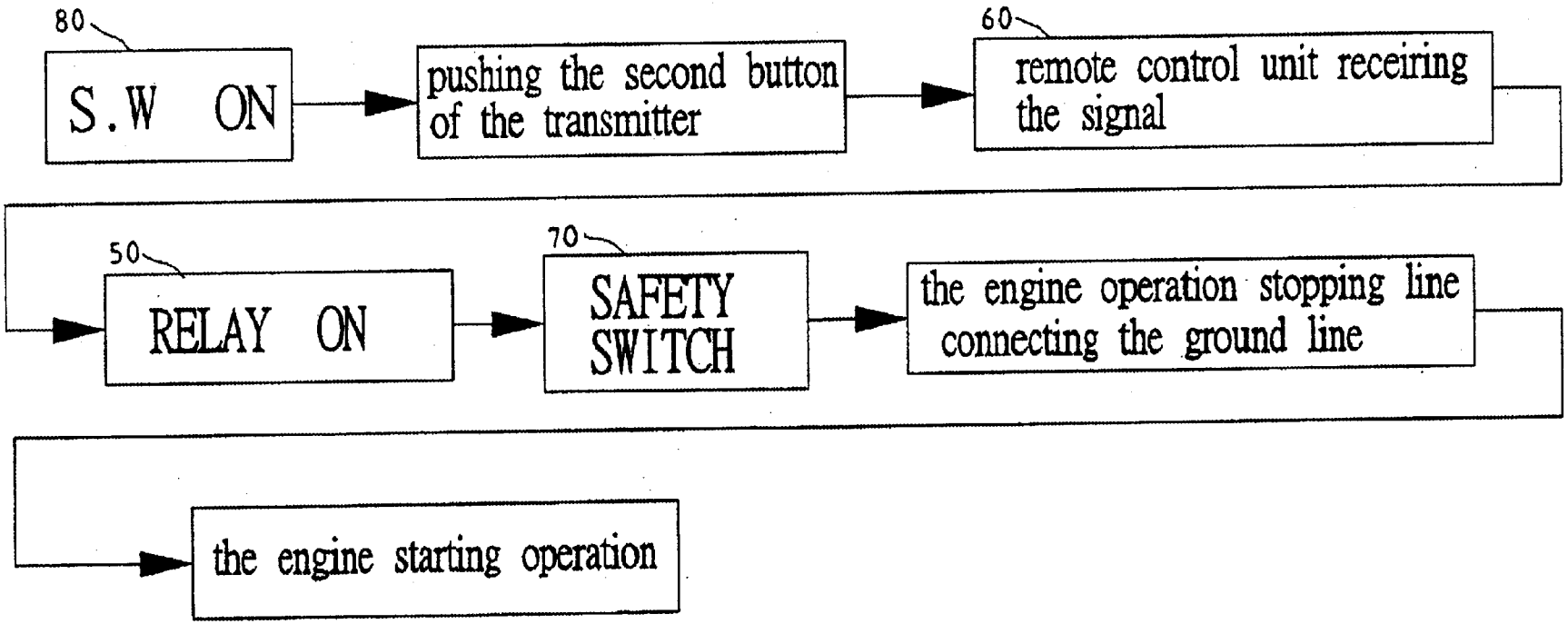
FIG. 6 is a flow chart of operating the safety remote control and emergency safety switch power shutoff device of a motorized beach vehicle in accordance with the preferred embodiment of the present invention.
Figure 7:
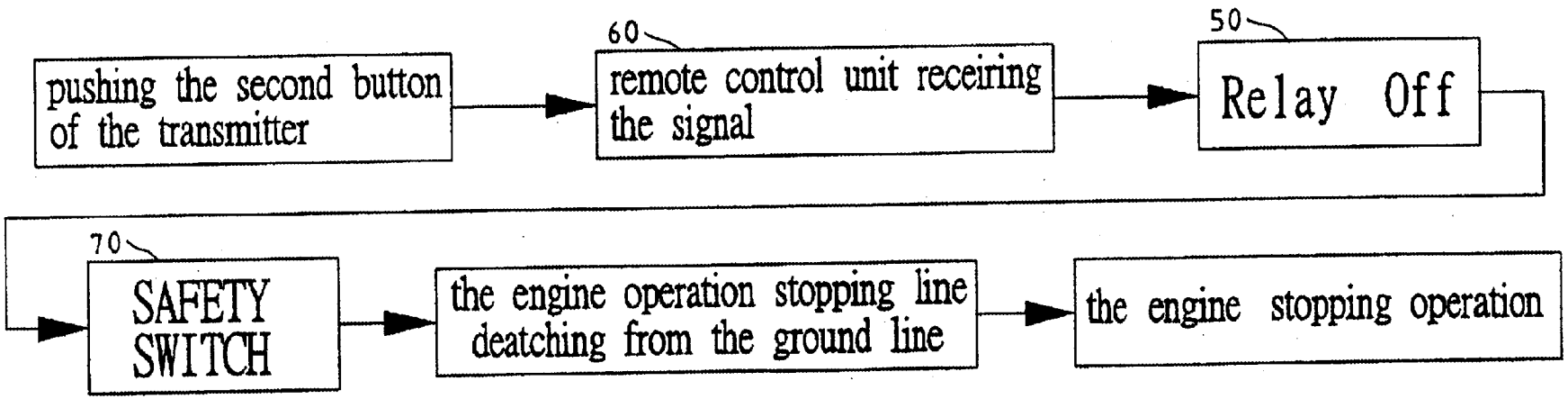
FIG. 7 is a flow chart of stopping operation of the safety remote control and emergency safety switch power shutoff device of a motorized beach vehicle in accordance with the preferred embodiment of the present invention.

In practice, referring to FIGS. 6 and 7, FIG. 6 is a flow chart of operating the safety remote control and emergency safety switch power shutoff device of a motorized beach vehicle in accordance with the preferred embodiment of the present invention, and FIG. 7 is a flow chart of stopping operation of the safety remote control and emergency safety switch power shutoff device of a motorized beach vehicle in accordance with the preferred embodiment of the present invention.

Thus, when the driver, such as a young man, is driving the motorized beach vehicle 10, the user, such as the parent or the coach, distant from the driver may push the switch buttons of the remote controller 80, so that the engine operation stopping line 31 of the CDI unit 30 of the driving motorized beach vehicle 10 may detach from the ground line, so as to stop operation of the motorized beach vehicle 10, thereby achieving the purpose of safely shutting the electrical power of the motorized beach vehicle 10, so as to protect the driver's safety.

Figure 8A:
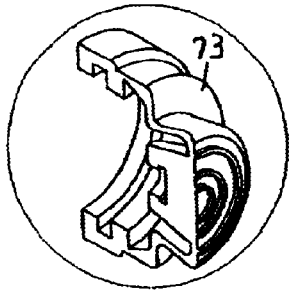
FIG. 8A is a perspective view of an elastic sleeve of the safety switch of the safety remote control and emergency safety switch power shutoff device of a motorized beach vehicle in accordance with the preferred embodiment of the present invention.
Figure 8:
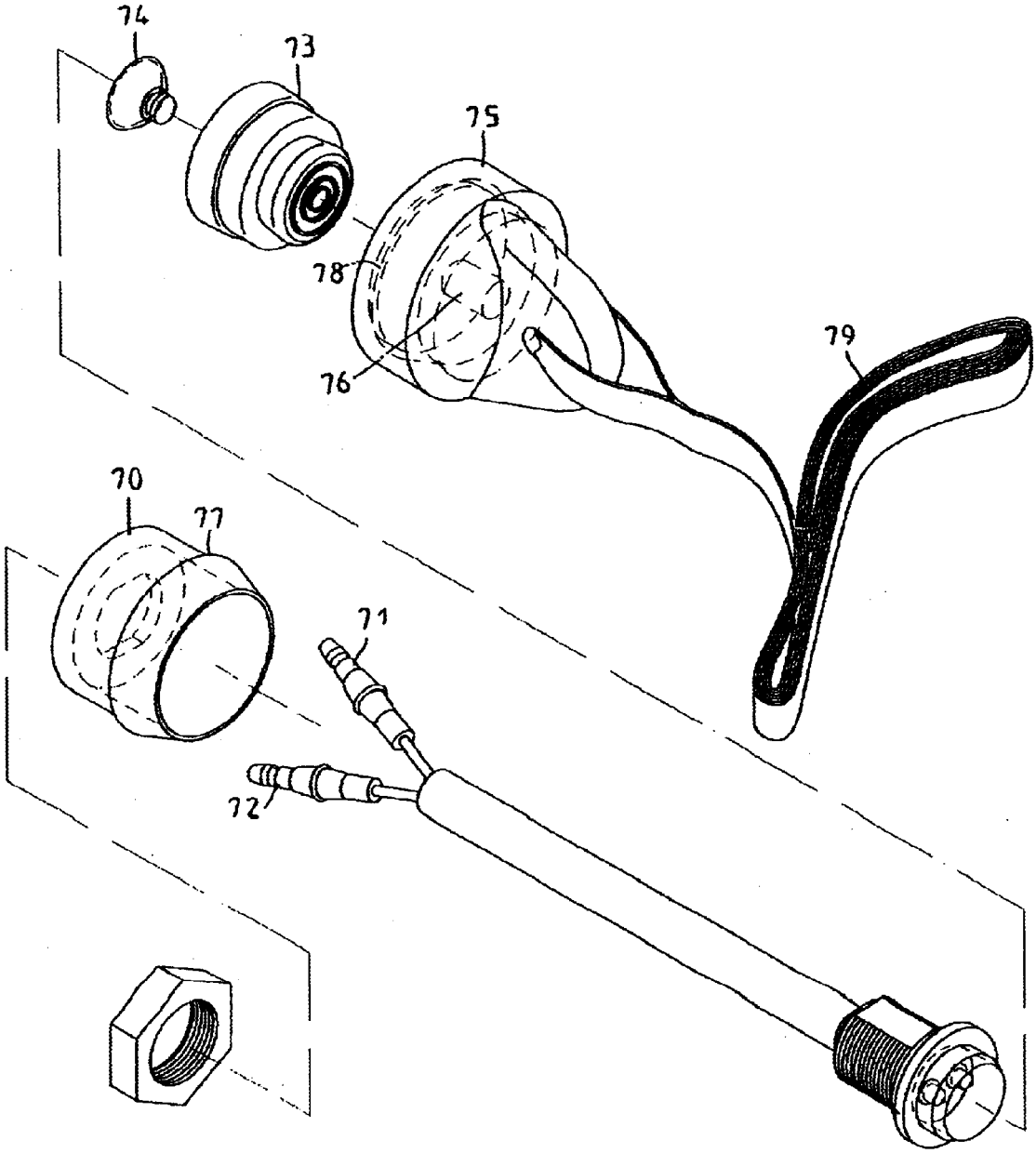
FIG. 8 is a schematic exploded perspective view of the safety switch of the safety remote control and emergency safety switch power shutoff device of a motorized beach vehicle in accordance with the preferred embodiment of the present invention.
Figure 9:
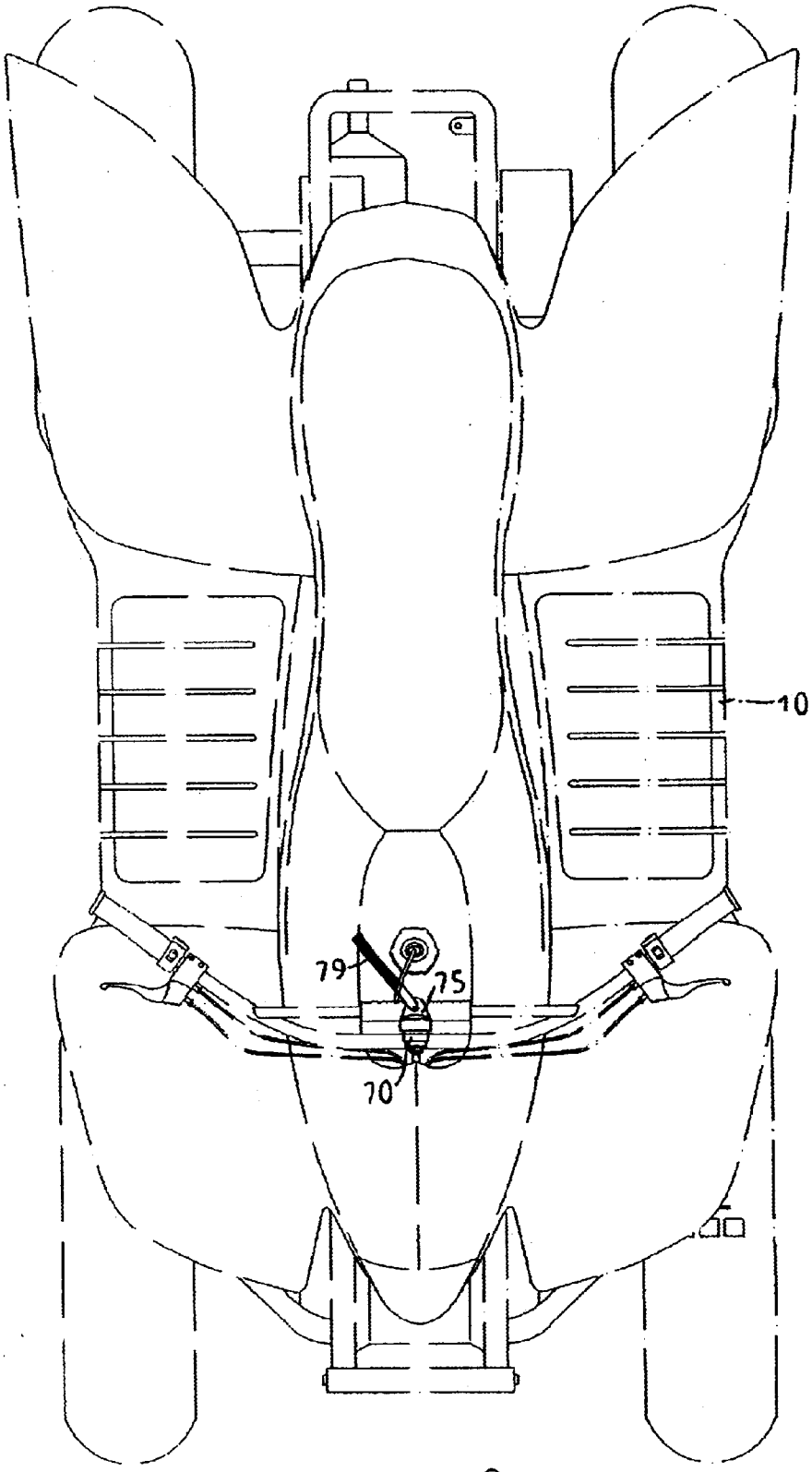
FIG. 9 is a top plan schematic operational view of the safety remote control and emergency safety switch power shutoff device of a motorized beach vehicle in accordance with the preferred embodiment of the present invention.

Referring to FIGS. 8 and 9, FIG. 8 is a schematic exploded perspective view of the safety switch of the safety remote control and emergency safety switch power shutoff device of a motorized beach vehicle in accordance with the preferred embodiment of the present invention, and FIG. 9 is a top plan schematic operational view of the safety remote control and emergency safety switch power shutoff device of a motorized beach vehicle in accordance with the preferred embodiment of the present invention.

The safety switch 70 includes two lines 71 and 72 connected to the relay 50. Each of the two lines 71 and 72 is disposed at a normally open state. An electrically conductive seat 74 is mounted on the two lines 71 and 72, and an elastic sleeve 73 (best shown in FIG. 8A) is mounted on the electrically conductive seat 74. The safety switch 70 is mounted on the elastic sleeve 73. A rubber cap 75 is mounted on the safety switch 70, and has a center provided with an actuation rod 76, for pressing the elastic sleeve 73, so that the electrically conductive seat 74 may connect the two lines 71 and 72 to form a circuit.

The rubber cap 75 has an inner wall formed with a snap groove 78, and the safety switch 70 has an outer wall provided with a snap hook 77 that may be snapped into the snap groove 78 of the rubber 75, so that the rubber 75 may be secured on the safety switch 70.

The rubber cap 75 is connected to a first end of a strap (or rope) 79 which has a second end that may be tied on the driver's body, so that when the driver falls from the motorized beach vehicle 10, the rubber cap 75 may be detached from the safety switch 70 by the strap 79.

Figure 10:
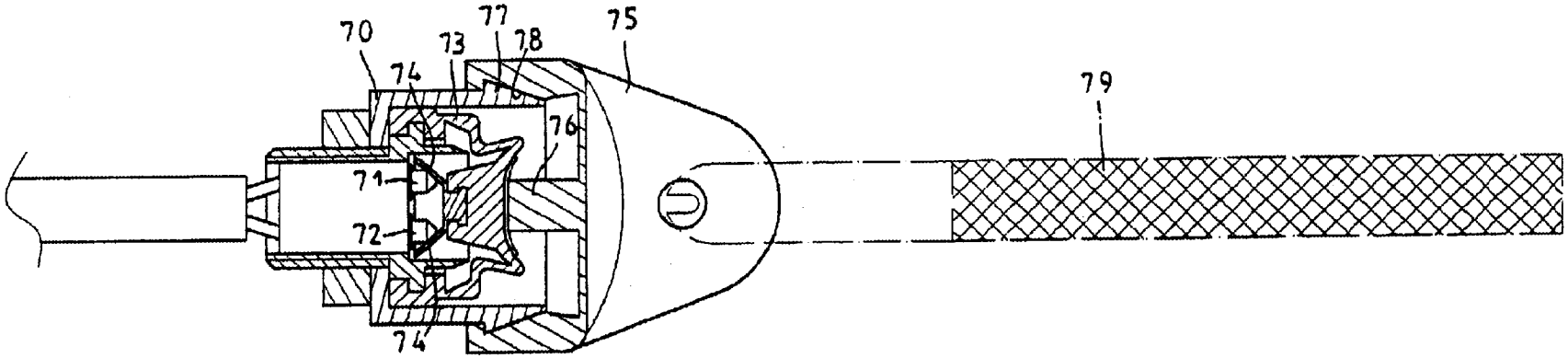
FIG. 10 is a side plan cross-sectional assembly view of the safety remote control and emergency safety switch power shutoff device of a motorized beach vehicle in accordance with the preferred embodiment of the present invention.
Figure 11:
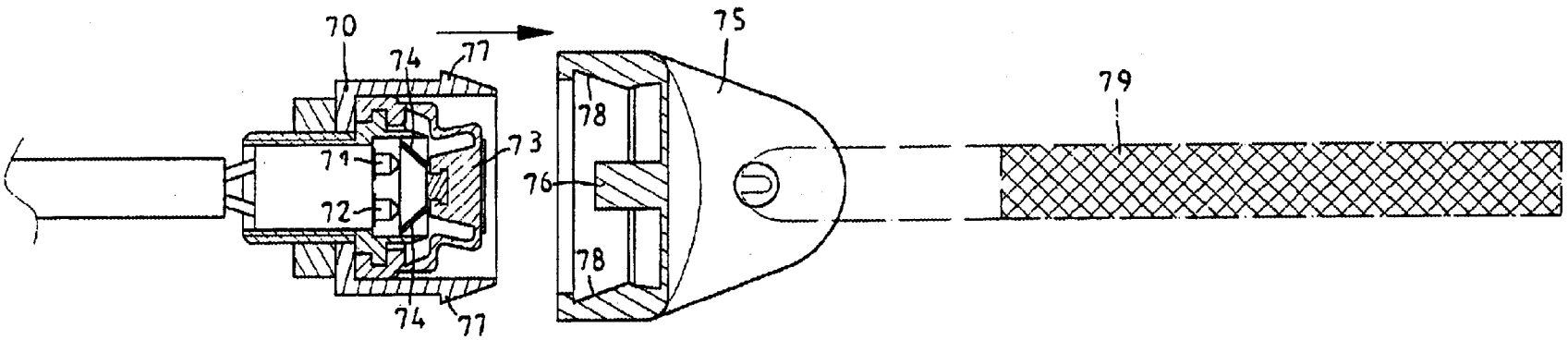
FIG. 11 is a side plan cross-sectional exploded view of the safety remote control and emergency safety switch power shutoff device of a motorized beach vehicle in accordance with the preferred embodiment of the present invention.

Referring to FIGS. 10 and 11, FIG. 10 is a side plan cross-sectional assembly view of the safety remote control and emergency safety switch power shutoff device of a motorized beach vehicle in accordance with the preferred embodiment of the present invention, and FIG. 11 is a side plan cross-sectional exploded view of the safety remote control and emergency safety switch power shutoff device of a motorized beach vehicle in accordance with the preferred embodiment of the present invention.

When the driver falls from the motorized beach vehicle 10 or when the driver cannot control and operate the motorized beach vehicle 10 normally, the strap (or rope) 79 tied on the driver's body may pull the rubber cap 75 which may be moved from the position as shown in FIG. 10 to the position as shown in FIG. 11, so that the rubber cap 75 may be automatically detached from the safety switch 70 by pulling of the strap 79, thereby shorting the lines 71 and 72 of the safety switch 70, and thereby disconnecting the engine operation stopping line 31 of the CDI unit 30 of the driving motorized beach vehicle 10, so as to stop operation of the motorized beach vehicle 10, thereby achieving the purpose of safely shutting the electrical power, so as to protect the driver's safety.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A motorized beach vehicle with a safety remote control and emergency safety switch power shutoff device, comprising an ACG (alternating current magneto generator) assembly, and a CDI (capacitor discharge ignition) unit for controlling an engine to operate normally or stop operating, an electrical power of the CDI unit being supplied by a battery, wherein:

the CDI unit has an engine operation stopping line that is connected to a relay, a remote control unit, and a safety switch;

the remote control unit receives an on/off signal transmitted from a remote controller, to energize the relay, so as to shutoff or conduct the engine operation stopping line of the CDI unit; and the safety switch includes two lines connected to the relay, each of the two lines is disposed at a normally open state, an electrically conductive seat is mounted on the two lines, an elastic sleeve is mounted on the electrically conductive seat, the safety switch is mounted on the elastic sleeve, a rubber cap is mounted on the safety switch, the rubber cap is connected to a first end of a strap which has a second end that is tied on a driver's body, so that the rubber cap is detached from the safety switch by the strap in an emergency condition.

2. The motorized beach vehicle with a safety remote control and emergency safety switch power shutoff device in accordance with claim 1, wherein the rubber cap has a center provided with an actuation rod, for pressing the elastic sleeve, so that the electrically conductive seat connects the two lines to form a circuit.

3. The motorized beach vehicle with a safety remote control and emergency safety switch power shutoff device in accordance with claim 1, wherein the rubber cap has an inner wall formed with a snap groove, and the safety switch has an outer wall provided with a snap hook that is snapped into the snap groove of the rubber, so that the rubber is secured on the safety switch.

* * * * *